US011503690B2

(12) United States Patent
Huang et al.

(10) Patent No.: US 11,503,690 B2
(45) Date of Patent: Nov. 15, 2022

(54) LIGHTING DEVICE AND POWER SWITCHING CIRCUIT

(71) Applicant: APUTURE IMAGING INDUSTRIES CO., LTD., Guangdong (CN)

(72) Inventors: Yi Huang, Guangdong (CN); Xiangjun Zhou, Guangdong (CN); Kun Tong, Guangdong (CN)

(73) Assignee: APUTURE IMAGING INDUSTRIES CO., LTD., Guangdong (CN)

( * ) Notice: Subject to any disclaimer, the term of this patent is extended or adjusted under 35 U.S.C. 154(b) by 0 days.

(21) Appl. No.: 17/536,033

(22) Filed: Nov. 28, 2021

(65) Prior Publication Data

US 2022/0330404 A1 Oct. 13, 2022

(30) Foreign Application Priority Data

Apr. 12, 2021 (CN) ..... 202110386175.0

(51) Int. Cl.
*H05B 47/10* (2020.01)

(52) U.S. Cl.
CPC ..... *H05B 47/10* (2020.01)

(58) Field of Classification Search
CPC ..... H05B 47/10
See application file for complete search history.

(56) References Cited

U.S. PATENT DOCUMENTS 10,045,407 B1 * 8/2018 Theunissen ..... H05B 47/10
10,833,611 B2 11/2020 Cox
2015/0015067 A1 1/2015 Wang
2017/0013694 A1 * 1/2017 Nakamura ..... H05B 45/385
2018/0166902 A1 * 6/2018 Huang ..... H02J 7/00
2020/0359483 A1 * 11/2020 Saito ..... H05B 45/46

FOREIGN PATENT DOCUMENTS

CN 104283301 A 1/2015
CN 208190338 U 12/2018
CN 111181148 A 5/2020
CN 112531878 A 3/2021

OTHER PUBLICATIONS

The First Office Action and Search Report dated May 13, 2021, for Aputure Imaging Industries Co., Ltd., from China Application No. 202110386175.0 and its translation (11 Pages).

* cited by examiner

*Primary Examiner* — Minh D A
(74) *Attorney, Agent, or Firm* — Mark M. Friedman

(57) ABSTRACT

A lighting device includes a light source and a power switching circuit including a plurality of power input circuits. Each of the power input circuits includes a power input terminal and a switch control circuit connected in series between the power input terminal and the light source. A control terminal of Nth switch control circuit controls the Nth switch control circuit to be turned off according to a first electrical signal input by first to (N-1)th power input terminals. The control terminal of the Nth switch control circuit controls the Nth switch control circuit to be turned on according to a second electrical signal being input by Nth power input terminal, and controls the first to (N-1)th switch control circuits to be turned off. The N is a positive integer greater than 1. A power switching circuit is also provided.

20 Claims, 6 Drawing Sheets

LIGHTING DEVICE AND POWER SWITCHING CIRCUIT

FIELD OF INVENTION

The present disclosure generally relates to a lighting device, and a power switching circuit.

BACKGROUND OF INVENTION

Generally, a light source of a lighting device is powered by a variety of power supplies, such as utility power and batteries. When one of the power supplies is turned off, the power supply is switched by a power switching circuit, so that the light source is powered by another power supply, thus to stably ensure the lighting device operate.

In order to reduce electricity cost of the lighting device and improve service life of the lighting device, for the power switching circuit utility power is preferred to supply power. When the utility power is turned off, the power switching circuit switches to battery or other power supplies to supply power.

However, when a battery supplies power to the light source, an power input terminal of an existing power switching circuit electrically connected with the utility power and the light source may be in a conducting state, to cause electric current supplied by the battery to flow reversely into an power input terminal of the utility power through the power input terminal of the power switching circuit, and cause the lighting device to operate unstably.

SUMMARY OF INVENTION

The present disclosure a lighting device, and a power switching circuit to solve the problem of existing lighting device operating unstably causing by the electric current flow revelry to the high priority circuit from the low priority circuit when the low priority circuit is electrically connected with the power switching circuit of the existing lighting device.

Firstly, an embodiment of the present disclosure provides a lighting device, the lighting device includes a light source and a power switching circuit. The power switching circuit includes:

a plurality of power input circuits. Each of the power input circuits includes a power input terminal and a switch control circuit connected in series between the power input terminal and the light source. Wherein a control terminal of an Nth switch control circuit is electrically connected with first to Nth power input terminals, an output terminal of the Nth switch control circuit is electrically connected with a control terminal of first to (N−1)th switch control circuits;

the control terminal of the Nth switch control circuit is configured to receive a first electrical signal input by one of first to (N−1)th power input terminals, and control the Nth switch control circuit to be turned off according to the first electrical signal.

in a condition that a second electrical signal input by the Nth power input terminal is received and the first electrical signal input by one of the first to (N−1)th power input terminals is not received, the control terminal of the Nth switch control circuit is configured to control the Nth switch control circuit to be turned on according to the second electrical signal, and control the first to (N−1)th switch control circuits to be turned off. Wherein the N is a positive integer greater than 1.

Optionally, the switch control circuit comprises a voltage divider circuit and at least one switch assembly, the switch assembly comprises two PMOSFET switch tubes (Q4n−1, Q4n) in a conducting state, a source of one of the two PMOSFET switch tubes (Q4n−1) is electrically connected with the power input terminal, a source of another of the two PMOSFET switch tubes (Q4n) is electrically connected with the light source, an input terminal of the voltage divider circuit is electrically connected with the power input terminal, and an output terminal of the voltage divider circuit is electrically connected with gates of the two PMOSFET switch tubes (Q4n−1, Q4n).

Optionally, the gates of the PMOSFET switch tubes (Q4n−3 to Q4n) of the Nth switch control circuit are electrically connected with the power input terminals corresponding to the first to (N−1)th switch control circuits.

Optionally, first diodes ($D_S((n-1)(n-2)+2)/2$ to $D_S n(n-1)/2$) are connected in series between the gates of the PMOSFET switch tubes (Q4n−3 to Q4n) of the Nth switch control circuit and the power input terminals corresponding to the first to (N−1)th switch control circuits, a positive electrode of each of the first diodes ($D_S((n-1)(n-2)+2)/2$ to $D_S n(n-1)/2$ is electrically connected with corresponding one of the power input terminals, a negative electrode of each of the first diodes ($D_S((n-1)(n-2)+2)/2$ to $D_S n(n-1)/2$ is electrically connected with corresponding one of the gates of the PMOSFET switch tubes (Q4n−3 to Q4n).

Optionally, drains of the PMOSFET switch tubes (Q4n−3 to Q4n) of the Nth switch control circuit are electrically connected with the gates of the PMOSFET switch tubes (Q1 to Q4n−4) of the first to (N−1)th switch control circuits.

Optionally, the second diodes ($D_K((n-1)(n-2)+2)/2$ to $D_K n(n-1)/2$) are connected in series between the drains of the PMOSFET switch tubes (Q4n−3 to Q4n) of the Nth switch control circuit and the gates of the PMOSFET switch tubes (Q1 to Q4n−4) for the first to (N−1)th switch control circuits, a positive electrode of each of the second diodes ($D_K((n-1)(n-2)+2)/2$ to $D_K n(n-1)/2$) is electrically connected with corresponding one of the output terminals of the switch control circuits, a negative electrode of each of the second diodes ($D_K((n-1)(n-2)+2)/2$ to $D_K n(n-1)/2$) is electrically connected with corresponding one of the gates of the PMOSFET switch tubes (Q1 to Q4n−4) for the first to (N−1) switch control circuits.

Optionally, each of the voltage divider circuits comprises a first electric resistance (R2n−1) and a second electric resistance (R2n), an input terminal of the first electric resistance (R2n−1) is electrically connected with the power input terminal, an output terminal of the first electric resistance (R2n−1) is electrically connected with an input terminal of the second electric resistance (R2n) and the gates of the two PMOSFET switch tubes (Q4n−1, Q4n), an output terminal of the second electric resistance (R2n) is connected with earth.

Optionally, each of the power input circuits further comprise a third diode ($D\text{-}_T n$), a positive electrode of the third diode ($D_T n$) is electrically connected with the output terminal of the first electric resistance (R2n−1), a negative electrode of the third diode ($D_T n$) is electrically connected with the gates of the two PMOSFET switch tubes (Q4n−3, Q4n).

Optionally, each of the switch control circuits comprises a plurality of switch assemblies, the plurality of switch assemblies are connected in parallel with each other, drains of the PMOSFET switch tubes (Q4n−3 to Q4n) of the plurality of switch assemblies are electrically connected with each other, in each of the switch assemblies, the source of one of the two PMOSFET switch tubes (Q4n−1) is electrically connected with the power input terminal, and the source of another of the PMOSFET switch tubes (Q4n) is electrically connected with the light source.

Secondly, according to another embodiment of the present invention provides a power switching circuit. The power switching circuit includes:

a plurality of power input circuits. Each of the power input circuits includes a power input terminal and a switch control circuit connected in series between the power input terminal and the light source. Wherein a control terminal of an Nth switch control circuit is electrically connected with first to Nth power input terminals, an output terminal of the Nth switch control circuit is electrically connected with a control terminal of first to (N−1)th switch control circuits.

the control terminal of the Nth switch control circuit is configured to receive a first electrical signal input by one of first to (N−1)th power input terminals, and control the Nth switch control circuit to be turned off according to the first electrical signal.

in a condition that a second electrical signal input by the Nth power input terminal is received and the first electrical signal input by one of the first to (N−1)th power input terminals is not received, the control terminal of the Nth switch control circuit is configured to control the Nth switch control circuit to be turned on according to the second electrical signal, and control the first to (N−1)th switch control circuits to be turned off. Wherein the N is a positive integer greater than 1.

In the power switching circuit of the lighting device provided by the present disclosure, the control terminal of the Nth switch control circuit of the plurality of power input circuit is electrically connected with the first to Nth power input terminals, and the output terminal of the Nth switch control circuit is electrically connected with the control terminal of first to (N−1)th switch control circuits.

In a condition that the Nth power input circuit is electrically connected with a power supply, while the first to (N−1)th power input circuits are not electrically connected with power supplies, the switch control circuit of the Nth power input circuit is turned on, and the light source is powered by the Nth power input circuit. In a condition that the first to (N−1)th power input circuits are electrically connected with power supplies, the switch control circuit of the Nth power input circuit is turned off, the light source is powered by the first to (N−1)th power input circuits.

Thereby, the plurality of power input circuits have a priority relationship between each other, and the priority relationship is: the first power input circuit>the second power input circuit>the third power input circuit > . . . >the Nth power input circuits.

Moreover, in a condition that the Nth power input circuit is electrically connected with a power supply, and the first to (N−1)th power input circuits are not electrically connected with power supplies, the switch control circuit of the Nth power input circuit is turned on, the switch control circuit of the Nth power input circuit controls the first to (N−1)th power input circuits to be turned off. Thereby, in a condition that the power supply electrically connected with the Nth power input circuit supplies power to the light source, and the power supplies electrically connected with first to (N−1) th power input circuits do not supply power to the light source, or the voltages of the power supplies electrically connected with the first to (N−1)th power input circuits are low, and the switch control circuits of the first to (N−1)th power input circuits are turned off. Thereby, when the power supply electrically connected with the low priority power input circuit supplies power to the light source, the electric current is prevented from flowing reversely to the high priority power input circuit, and thus the lighting device is able to work stably.

DESCRIPTION OF DRAWINGS

Technical solution and other beneficial effects of the present disclosure will be obviously through the detailed description of the specific embodiment of the present disclosure in combination with drawings.

Figure 1:
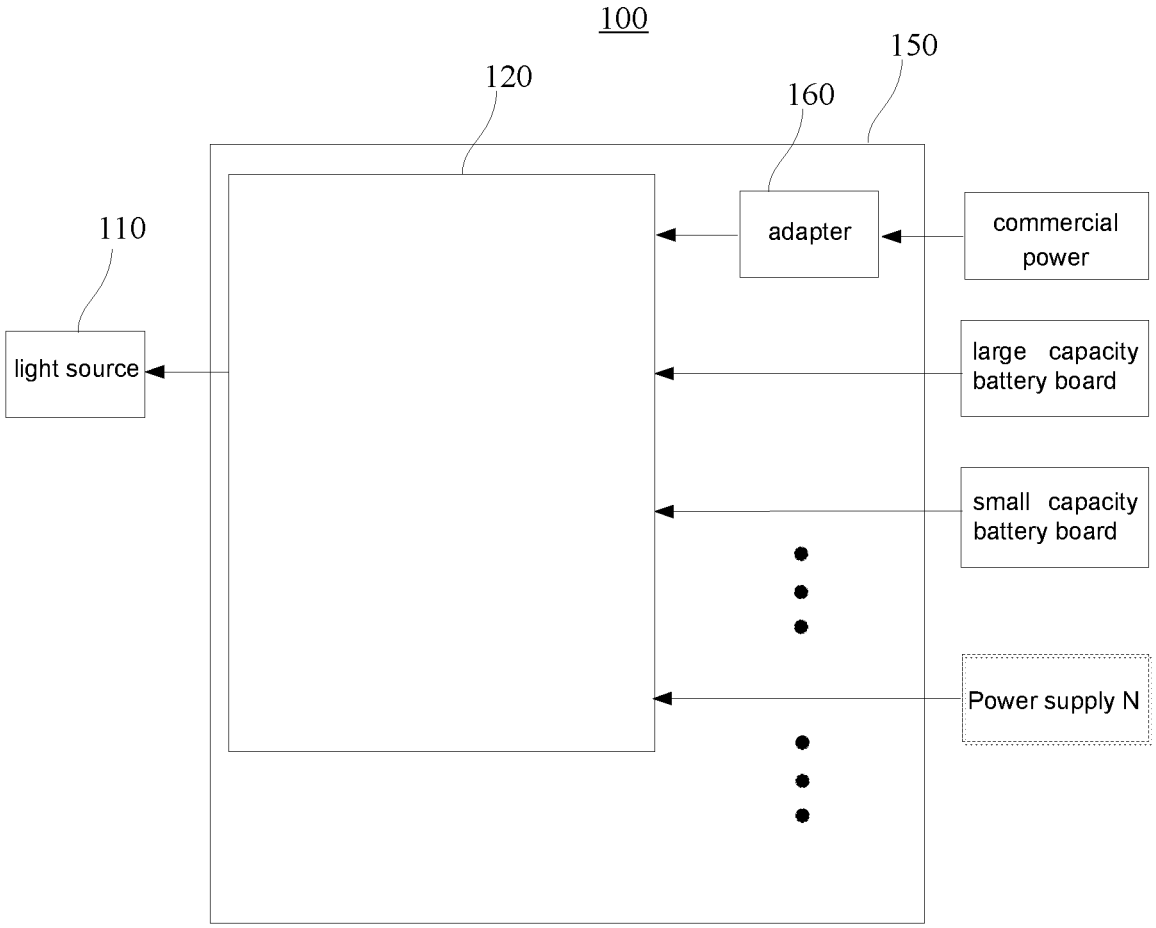
FIG. 1 is a structural schematic diagram showing a lighting device provided by an embodiment of the present disclosure.

Lighting device 100; light source 110; power switching circuit 120; power input circuit 121; switch control circuit 122; switch assembly 1221; power input terminal 123; voltage divider circuit 124; control box 150; adapter 160; first resistor R1, R3 . . . R2n−1; second resistor R2, R4 R2n; first diode $D_S1$, $D_S2$ . . . $D_Sn(n-1)/2$; second diode $D_K1$, $D_K2$ . . . $D_Kn(n-1)/2$; third diode $D_T1$, $D_T2$ . . . $D_Tn$; PMOSFET switch tube Q1, Q2 . . . Q4n.

DETAILED DESCRIPTION OF PREFERRED EMBODIMENTS

Technical solutions in embodiments of the present disclosure will be described clearly and completely in combination with the drawings in the embodiments of the present disclosure. Obviously, the embodiments described are only part of the embodiments of the present disclosure, not all embodiments. According to the embodiments in the present disclosure, all other embodiments obtained by those of skill in the art that the embodiments described herein without making creative work belong to the protection scope of the present disclosure.

In description of the disclosure, it should be understood that, orientational relationships represented by directional terms mentioned in the present disclosure, such as center, longitudinal, transverse, length, width, thickness, up, down, front, back, left, right, vertical, horizontal, top, bottom, inside, outside, clockwise, anticlockwise, etc., are orientational relationships based on the drawings, and are merely for the convenience of describing the present disclosure and simplifying the description, instead of indicating or implying that the device or element referred to must have a specific orientation, be constructed and operated in the specific orientation, and should not be interpreted as a limitation of the application. Furthermore, the terms "first" and "second" are used for descriptive purposes only, and cannot be understood as indicating or implying relative importance or implicitly indicating the number of technical features indicated. Thus, the features defined as "first" and "second" may explicitly or implicitly include one or more of the features. In description of the disclosure, "plurality" means two or more, unless otherwise specified.

In description of the disclosure, it should be noted that, unless there is clear regulations and limits, the terms "installation", "connection" and "connection" should be understood in a broad sense. For example, it can be fixed connection, detachable connection or integrated connection; it can be mechanical connection, electrical connection or mutual communication; it can be directly connected, or indirectly connected through intermediate media, or the internal connection of two components or the interaction relationship between two components. For those of ordinary skill in the art that the embodiments described herein, the specific meaning of the above terms in the present disclosure can be understood according to the specific situation.

In the present disclosure, unless there is clear regulations and limits, the first feature "up" or "down" of the second feature may include direct contact between the first and second features, and may also include the first and second features are not in direct contact but contacted through other feature between them. Moreover, the first feature "above" and "upper " of the second feature includes that the first feature is directly above and obliquely above the second feature, or only indicates that the horizontal height of the first feature is higher than that of the second feature. The first feature "below" and "under" of the second feature includes that the first feature is directly below and obliquely below the second feature, or only indicates that the horizontal height of the first feature is less than that of the second feature.

The following disclosure provides many different embodiments or examples to implement different structures of the present disclosure. In order to simplify the disclosure of the present disclosure, components and settings of specific examples are described below. Of course, they are only examples, and are not intended to limit the present disclosure. In addition, the present disclosure may repeat reference numerals and/or reference letters in different examples, such repetition is for the purpose of simplification and clarity, and does not indicate the relationship between the various embodiments and/or settings discussed. In addition, the present disclosure provides embodiments of various specific processes and materials, but those of ordinary skill in the art may be aware of the application of other processes and/or the use of other materials.

The embodiment of the present disclosure provides a lighting device, a power switching circuit and a power switching method of the lighting device. The following is a detailed description of them.

FIG. 1 illustrates an embodiment of a lighting device 100. The lighting device 100 includes a light source 110 and a power switching circuit 120. The power switching circuit 120 is configured to electrically connect with different power supplies, and control the different supplies to supply power for the light source 110.

Specifically, for example, the power supplies providing power for the lighting device 100 may be multiple types of power supplies, such as a utility power, a large capacity battery board or a small capacity battery board. The multiple types of power supplies are electrically connected with power input terminals 123 of different power input circuits 121 respectively, and supply power to the light source selectively. Certainly, an AC/DC adapter 160, a boost circuit, etc. are disposed between the power input terminal 123 and the power supply. The number of the power supply providing power for the lighting device 100 may be 2, 3, 4 or more.

Figure 2:
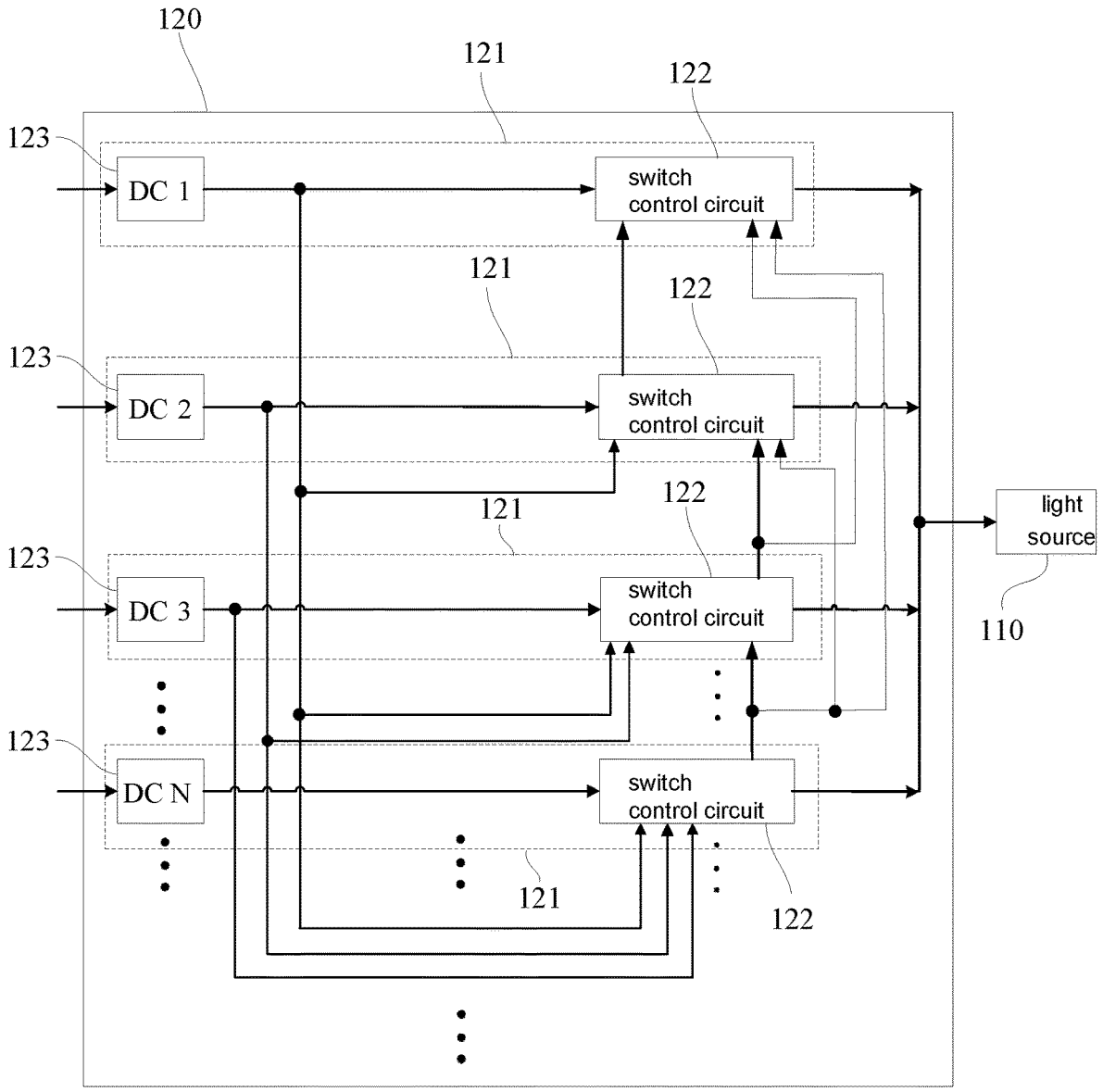
FIG. 2 is a circuit structural block diagram of a lighting device provided by an embodiment of the present disclosure.

As is shown in FIG. 2, the power switching circuit 120 includes a plurality of power input circuits 121. Each of the power input circuits 121 includes a switch control circuit 122 and a power input terminal 123. The switch control circuit 122 connected in series between the power input terminal 123 and the light source 110. The power input terminals 123 of the plurality of power input circuits 121 are configured to electrically connect with different power supplies, and supply power to the light source 110, so as to operate the light source 110, when the switch control circuit 122 is turned on. The switch control circuit 122 electrically connects the light source 110 directly. Alternatively, the switch control circuit 122 electrically connects the light source 110 indirectly. That is, other circuits (such as step-down, step-up, voltage stabilization circuits, etc.) or electronic components are provided between the switch control circuit 122 and the light source 110.

A control terminal of an Nth switch control circuit 122 is electrically connected with first to Nth power input terminals 123. The control terminal of the Nth switch control circuit 122 is configured to receive a first electrical signal input by one of first to (N−1)th power input terminals 123, and control the Nth switch control circuit 122 to be turned off according to the first electrical signal. Thereby, when first to (N−1)th power input circuits 121 is electrically connected with power supplies, the switch control circuit 122 of the Nth power input circuit 121 is turned off.

Moreover, a control terminal of the Nth switch control circuit 122 is electrically connected with the Nth power input terminal 123. In a condition that a second electrical signal input by the Nth power input terminal 123 is received, and the first electrical signal input by one of the first to (N−1)th power input terminals 123 is not received, the control terminal of the Nth switch control circuit 122 is configured to control the Nth switch control circuit 122 to be turned on according to the second electrical signal, so that the Nth power input terminal 123 is electrically connected with the power supply. In a condition that the first to (N−1)th power input terminals 123 are not electrically connected with the power supply, or in a condition that the voltages of the power supplies electrically connected with the first to (N−1)th power input terminals 123 are low, the Nth switch control circuit 122 is turned on, and the light source 110 is supplied by the power supply connected with the Nth power input terminal 123.

In the power switching circuit 120 of the embodiment of the present application, the control terminal of the Nth switch control circuit 122 is electrically connected with the first to Nth power input terminals 123, so that the control terminal of the Nth switch control circuit 122 receives the first electrical signal input by the first to (N−1)th power input terminals 123, and controls the Nth switch control circuit 122 to be turned off according to the first electrical signal. Moreover, in a condition that the second electrical signal input by the Nth power input terminal 123 is received and the first electrical signal input by the first to (N−1)th power input terminals 123 is not received, the control terminal of the Nth switch control circuit 122 is configured to control the Nth switch control circuit 122 to be turned on according to the second electrical signal. Thereby, it is ensured that the plurality of power input circuits 121 has a priority relationship between each other, and the priority relationship is: the first power input circuit 121 >the second power input circuit 121>the third power input circuit 121> . . . >the Nth power input circuits 121.

In a condition that the first power input circuit 121 is electrically connected with a power supply, the second to Nth switch control circuits 122 connected with the power supplies are turned off, the light source 110 is powered by the power supply electrically connected with the first power input circuit 121. Even if the second to Nth power input circuits 121 are electrically connected with the power supplies, they are not possible to supply power to the light source 110.

In a condition that the first power input circuit 121 is not electrically connected with the power supply, and the second power input circuit 121 is electrically connected with a power supply, the power supply electrically connected with the second power input circuit 121 supplies power to the light source 110. Even if the third to Nth power input circuits 121 are electrically connected with power supplies, they are not possible to supply power to the light source 110. If the first power input circuit 121 is electrically connected with the power supply again at this time, and the voltage of the power supply electrically connected with the first power input circuit 121 reaches a preset voltage (e.g. being equal to or great than the preset voltage), the switch control circuit 122 of the second power input circuit 121 is turned off, and the power supply electrically connected with the first power input circuit 121 supplies power to the light source 110.

As is shown in FIG. 2, an output terminal of the Nth switch control circuit 122 is electrically connected with control terminals of the first to (N−1)th switch control circuits 122. In a condition that the second electrical signal input by the Nth power input terminal 123 is received and the first electrical signal input by one of the first to (N−1)th power input terminals 123 is not received, the control terminal of the Nth switch control circuit 122 is configured to control the first to (N−1)th switch control circuits 122 to be turned off according to the second electrical signal.

Thereby, in a condition that the power supply electrically connected with the Nth power input circuit 121 supplies power to the light source 110, and the first to (N−1)th power input circuits 121 do not supply power to the light source 110, or in a condition that voltages of the power supply electrically connected with the first to (N−1)th power input circuits 121 are low, it is ensured that the switch control circuits 122 of the first to (N−1)th power input circuits 121 are turned off, to prevent the electric current from flowing reversely into high priority power input circuit 121 from the light source 110, when the power supply electrically connected with low priority power input circuit 121 supplies power to the light source 110, thus improving stability of the light device 100.

The N is a positive integer greater than 1. It should be noted that, the Nth switch control circuit 122 may be a switch control circuit 122 of any one of the plurality of power input circuits 121. For example, the power switching circuit 120 includes 10 power input circuits 121, the Nth switch control circuit 122 may be the switch control circuit 122 of the first power input circuit 121, or the switch control circuit 122 of any one of the 10 power input circuits 121, such as, the first, the third, the sixth, or the tenth power input circuits 121, which are not limited herein.

Moreover, the N is a positive integer greater than 1. It is understandable that the amount of the power input terminal 123 is 2 or more (e.g. 3, 4, etc.). In other words, the power supplies include a utility power, a lithium battery, or a storage battery, etc. If the N is 1, there is no other power input circuit 121 before the first power input circuit 121, thus it is not required for the control terminal of the first power input circuit 121 to electrically connected with power input terminal 123 of other power input circuit 121, and it is not required for the output terminal of the first power input circuit 121 to electrically connected with the control terminal of other power input circuit 121 too.

Figure 3:
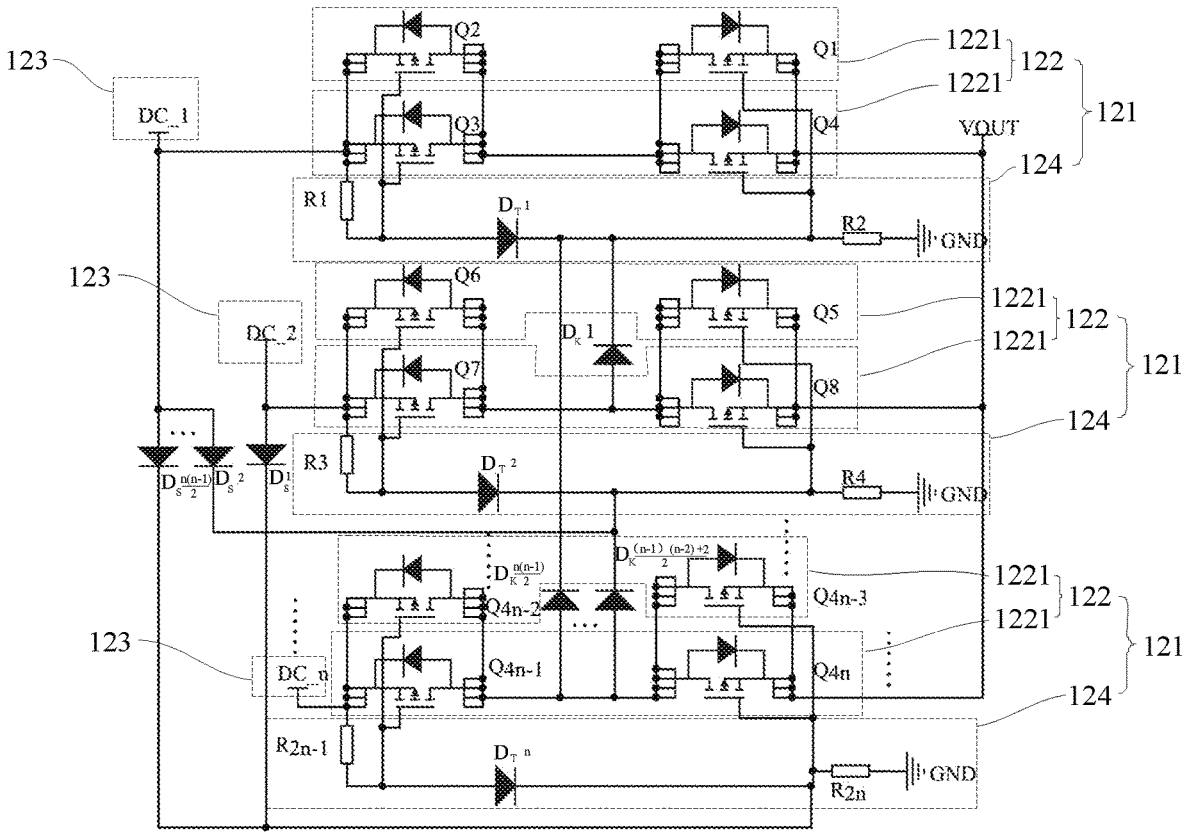
FIG. 3 is a circuit diagram of a power switching circuit including a plurality of power input circuits provided by an embodiment of the present disclosure.

Optionally, As is shown in FIG. 3, the switch control circuit 122 includes a voltage divider circuit 124 and at least one switch assembly 1221. The switch assembly 1221 includes two PMOSFET switch tubes (Q4n−1, Q4n) in a conducting state. A source of one of the two PMOSFET switch tubes Q4n−1 is electrically connected with the power input terminal 123, and a source of another of the two PMOSFET switch tubes Q4n is electrically connected with the light source 110. An input terminal of the voltage divider circuit 124 is electrically connected with the power input terminal 123, an output terminal of the voltage divider circuit 124 is electrically connected with gates of the two PMOSFET switch tubes (Q4n−1, Q4n).

When the power input terminal 123 of the power input circuit 121 is electrically connected with a corresponding power supply, the voltage divider circuit 124 is able to adjust the voltage difference between the power input terminal 123 of the power input circuit 121 (i.e. the source of the two PMOSFET switch tubes (Q4n−1, Q4n)) and the gates of the two PMOSFET switch tubes (Q4n−1, Q4n), so that source voltages of the two PMOSFET switch tubes (Q4n−1, Q4n) are greater than gate voltages of the two PMOSFET switch tubes (Q4n−1, Q4n), and the voltage difference between the source voltages and the gate voltages reach a threshold. Thereby, the two PMOSFET switch tubes (Q4n−1, Q4n) of the switch assembly 1221 are turned on, and the power supply electrically connected with the power input terminal 123 supplies power to the light source 110.

Moreover, the switch assembly 1221 includes two PMOSFET switch tubes (Q4n−1, Q4n) with drains electrically connected with each other. Thereby, when one of the plurality of power input circuits 121 is supplying power to the light source 110, the electric current is prevented from flowing reversely into other power input circuits 121 from a parasitic diode of the PMOSFET switch tube of other power input circuit 121 of the power switching circuit 120.

Optionally, As is shown in FIG. 3, each of the power input circuits 121 includes a plurality of switch assemblies 1221. The plurality of switch assemblies 1221 are connected in parallel with each other, in other words, the PMOSFET switch tube Q4n−2 is connected in parallel with the PMOSFET switch tube Q4n−1 to form a first parallel structure, the PMOSFET switch tube Q4n−3 is connected in parallel with the PMOSFET switch tube Q4n to form a second parallel structure, and then the first parallel structure and the second parallel structure connect in series with each other. The drains of the PMOSFET switch tubes (Q4n−3 to Q4n) of the plurality of switch assemblies 1221 are electrically connected with each other. In each of the switch assemblies 1221, the source of one of the PMOSFET switch tubes (Q4n−2, Q4n−1) is electrically connected with the power input terminal 123, and the source of another of the PMOSFET switch tubes (Q4n−3, Q4n) is electrically connected with the light source 110. The number of the plurality of switch assembly 1221 maybe 1, 2, 3, or more, which are not limited herein.

The plurality of switch assemblies 1221 are connected in parallel with each other, and thus the plurality of switch assemblies 1221 are able to share current in high current application scenarios, and reduce heat generated from each PMOSFET switch tube, thereby reducing wastage of the power switching circuit 120, and improving lifetime of the power switching circuit 120.

Specifically as is shown in FIG. 3, the number of the switch assemblies 1221 of the Nth power input circuit 121 is two. Each of the two switch assemblies 1221 includes two PMOSFET switch tubes (Q4n−3, Q4n). In each of the switch assemblies 1221, the source of one of the two PMOSFET switch tubes (Q4n−2, Q4n−1) is electrically connected with the power input terminal 123 of the Nth power input circuit 121, and the source of another of the two PMOSFET switch tubes (Q4n−3, Q4n) is electrically connected with the light source 110.

In some embodiment, As is shown in FIG. 3, the gates of the PMOSFET switch tubes (Q4n−3 to Q4n) of the Nth switch control circuit 122 are electrically connected with the power input terminal 123 electrically corresponding to the first to (N−1)th switch control circuits 122. In other words, the gates of the PMOSFET switch tubes (Q4n−3 to Q4n) electrically connected with the Nth power input terminals 123 are electrically connected with the first to (N−1)th power input terminals 123, for ensuring that the priority relationship between each of the plurality power input circuits 121 of the power switching circuit 120 is able to be guaranteed.

It is understandable that, the conducting condition of the PMOSFET switch tubes (Q4n−3 to Q4n) is that when a gate voltage Ug is smaller than a source voltage Us, and voltage difference between the gate voltage Ug and the source voltage Us is greater than the preset threshold, then the source and the drains of the PMOSFET switch tubes (Q4n−3 to Q4n) are in conducting states.

The gates of the PMOSFET switch tubes (Q4n−3 to Q4n) of the Nth switch control circuit 122 are electrically connected with the power input terminal 123 electrically corresponding to the first to (N−1)th switch control circuits 122. When the power input terminal 123 of the high priority power input circuit 121 (e.g. the power input terminal 123 of the first power input circuit 121) is electrically connected with the power supply, the gates of the PMOSFET switch tubes (Q4n−3 to Q4n) of the switch assembly 1221 of the low priority power input circuit 121 (e.g., the second power input circuit 121) is in a high voltage state. Even if the power input terminal 123 of the low priority power input circuit 121 is electrical connected with the power supply, the voltage difference between the gates and the source of the PMOSFET switch tubes (Q4n−3 to Q4n) of the switch assembly 1221 of the low priority power input circuit 121 cannot satisfy the preset threshold required by the conducting of the PMOSFET switch tubes (Q4n−3 to Q4n).

Thereby, in a condition that the power input terminal 123 of the high priority power input circuit 121 is electrically connecting with the power supply, the PMOSFET switch tubes (Q4n−3 to Q4n) of the switch assembly 1221 of the low priority power input circuit 121 remain in an off state, to ensure the priority relationship between the plurality of power input circuits 121 of the power switching circuit 120.

Moreover, the structure of the power switching circuit 120 is simple, and does not include complex control chip. The controlling of the power switching circuit 120 is realized through pure circuit structures, and no complicated control chip is involved. Not only can the response speed of the power switching circuit 120 be faster, but also the manufacturing cost is lowered, and the stability is improved.

Optionally, as is shown in FIG. 3, first diodes ($D_S((n-1)(n-2)+2)/2$ to $D_S n(n-1)/2$) are connected in series between the gates of the PMOSFET switch tubes (Q4n−3 to Q4n) of the Nth switch control circuit 122 and the power input terminals 123 corresponding to the first to (N−1)th switch control circuits 122. A positive electrode of each of the first diodes ($D_S((n-1)(n-2)+2)/2$ to $D_S n(n-1)/2$) is electrically connected with corresponding one of the power input terminals 123. A negative electrode of each of the first diodes ($D_S((n-1)(n-2)+2)/2$ to $D_S n(n-1)/2$) is electrically connected with corresponding one of the gates of the PMOSFET switch tubes (Q4n−3 to Q4n). When the power input terminal 123 of the low priority power input circuit 121 is electrically connected with the power supply, the electric current of the low priority power input circuit 121 is prevented from flowing reversely into the high priority power input circuit 121, thus improving the stability of the lighting device 100.

Specifically, the gates of the PMOSFET switch tubes (Q4n−3 to Q4n) of the Nth switch control circuits 122 are electrically connected with the corresponding power input terminals 123 of the first to (N−1)th switch control circuits 122 through conducting wires, and the first diodes ($D_S((n-1)(n-2)+2)/2$ to $D_S n(n-1)/2$) are connected in series on one of the conducting wires.

Optionally, As is shown in FIG. 3, the drains of the PMOSFET switch tubes (Q4n−3 to Q4n) of the Nth switch control circuits 122 are electrically connected with the gates of the PMOSFET switch tubes (Q1 to Q4n−4) of the first to (N−1)th switch control circuits 122. When the power supply electrically connected with the Nth power input circuit 121 is supplying power to the light source 110, the Nth power input circuit 121 is able to apply a preset voltage to the gates of the PMOSFET switch tubes (Q1 to Q4n−4) of the first to (N−1)th power input circuits 121, to ensure that the PMOSFET switch tubes (Q1 to Q4n−4) of the first to (N−1)th power input circuits 121 are in an off state.

Second diodes ($D_K((n-1)(n-2)+2)/2$ to $D_K n(n-1)/2$) are connected in series between the drains of the PMOSFET switch tubes (Q4n−3 to Q4n) of the Nth switch control circuit 122 and the gates of the PMOSFET switch tubes (Q1 to Q4n−4) of the first to (N−1)th switch control circuits 122. A positive electrode of each of the second diodes ($D_K((n-1)(n-2)+2)/2$ to $D_K n(n-1)/2$) is electrically connected with corresponding one of the output terminals of the switch control circuits 122. A negative electrode of each of the second diodes ($D_K((n-1)(n-2)+2)/2$ to $D_K n(n-1)/2$) is electrically connected with corresponding one of the gates of the PMOSFET switch tubes (Q1 to Q4n−4). When the power input terminal 123 of the high priority power input circuit 121 is electrically connected with the power supply, the electric current of the high priority power input circuit 121 is prevented from flowing into the low priority power input circuit 121, thus improving the stability of the lighting device 100.

As is shown in FIG. 3, the voltage divider circuit 124 may include a first resistor (R1, R3 . . . R2n−1) and a second resistor (R2, R4 . . . R2n). An input terminal of the first resistor (R1, R3 . . . R2n−1) is electrically connected with the power input terminal 123, an output terminal of the first resistor (R1, R3 . . . R2n−1) is electrically connected with an input terminal of the second resistor (R2, R4 . . . R2n) and corresponding one of the gates of the two corresponding PMOSFET switch tubes (Q4n−1, Q4n), an output terminal of the second resistor (R2, R4 . . . R2n) is connected with earth.

When the power input terminal 123 of the power input circuit 121 is electrically connected with the power supply, the power supply supplies voltage to the input terminal of the first resistor (R1, R3 . . . R2n−1) of the voltage divider circuit 124, the first resistor (R1, R3 . . . R2n−1) and the second resistor (R2, R4 . . . R2n) divide the voltage, so that the voltage of the input terminal of the first resistor (R1, R3 . . . R2n−1) is smaller than the output terminal of the first resistor (R1, R3 . . . R2n−1), and the voltage difference between the input terminal and the output terminal of the first resistor (R1, R3 . . . R2n−1) reaches the preset threshold which turns on the PMOSFET switch tubes (Q4n−1, Q4n) of the switch assembly 1221.

It is understood that the input terminal of the first resistor (R1, R3 . . . R2n−1) is electrically connected with the power input terminal 123, and the output terminal of the first resistor (R1, R3 . . . R2n−1) is electrically connected with the input terminal of the second resistor (R2, R4 . . . R2n) and corresponding one of the gates of the two PMOSFET switch tubes (Q4n−1, Q4n). Thereby, when the power input terminal 123 of the power input circuit 121 is electrically connected with the power supply, the voltage of the input terminal of the first resistor (R1, R3 . . . R2n−1) is equal to the source voltage of corresponding one of the PMOSFET switch tube (Q4n−1) of the power input terminal 123, and the voltage of the output terminal of the first resistor (R1, R3 . . . R2n−1) is equal to the gate voltage of corresponding one of the PMOSFET switch tube (Q4n−1) of the power input terminal 123. Thus the PMOSFET switch tube (Q4n−1) of the switch assembly 1221 directly electrically connected with the power input terminal 123 is in a conducting state.

Then, the electric current of the power input circuit 121 flows through a parasitic diode of another of the PMOSFET switch tube (Q4n) of the switch assembly 1221, and flows out of the source of another of the PMOSFET switch tube (Q4n), so that the source voltage of another of the PMOSFET switch tube (Q4n) is greater than the gate voltage of another of the PMOSFET switch tube (Q4n), thus rendering another of the PMOSFET switch tube (Q4n) in a conducting state.

Each of the power input circuits 121 further include a third diode ($D_7$n). A positive electrode of the third diode ($D_7$n) is electrically connected with the output terminal of the first resistor (R2n−1). A negative electrode of the third diode ($D_7$n) is electrically connected with the gates of the two PMOSFET switch tubes (Q4n−3, Q4n) of the switch assembly 1221.

It is understandable that in order to ensure that when the supply power electrically connected with the Nth power input circuit 121 supplies power to the light source 110, the switch assemblies 1221 of the first to (N−1)th power input circuits 121 are in off states, the drains of the PMOSFET switch tubes (Q4n−3, Q4n) of the Nth power input circuit 121 apply voltage to the gates of the PMOSFET switch tubes (Q1, Q4n−4) of the first to (N−1)th power input circuits 121.

In the embodiment of the present disclosure, by disposing the third diode ($D_7$n) between the output terminal of the first resistor (R2n−1) and the gates of the PMOSFET switch tubes (Q4n−3, Q4n) of the switch assembly 1221, the drains of the PMOSFET switch tubes (Q4n−3, Q4n) of the low priority power input circuit 121 is prevented from applying voltage onto the gate of the PMOSFET switch tubes (Q1, Q4n−4) of the power input circuit 121 and acting reversely on high priority power input circuit 121 through the first resistor (R2n−1), thereby further improving the stability of the power input circuit 120.

The working process of an embodiment of the lighting device 100 with the power switching circuit 120 is described in detail below.

Figure 4:
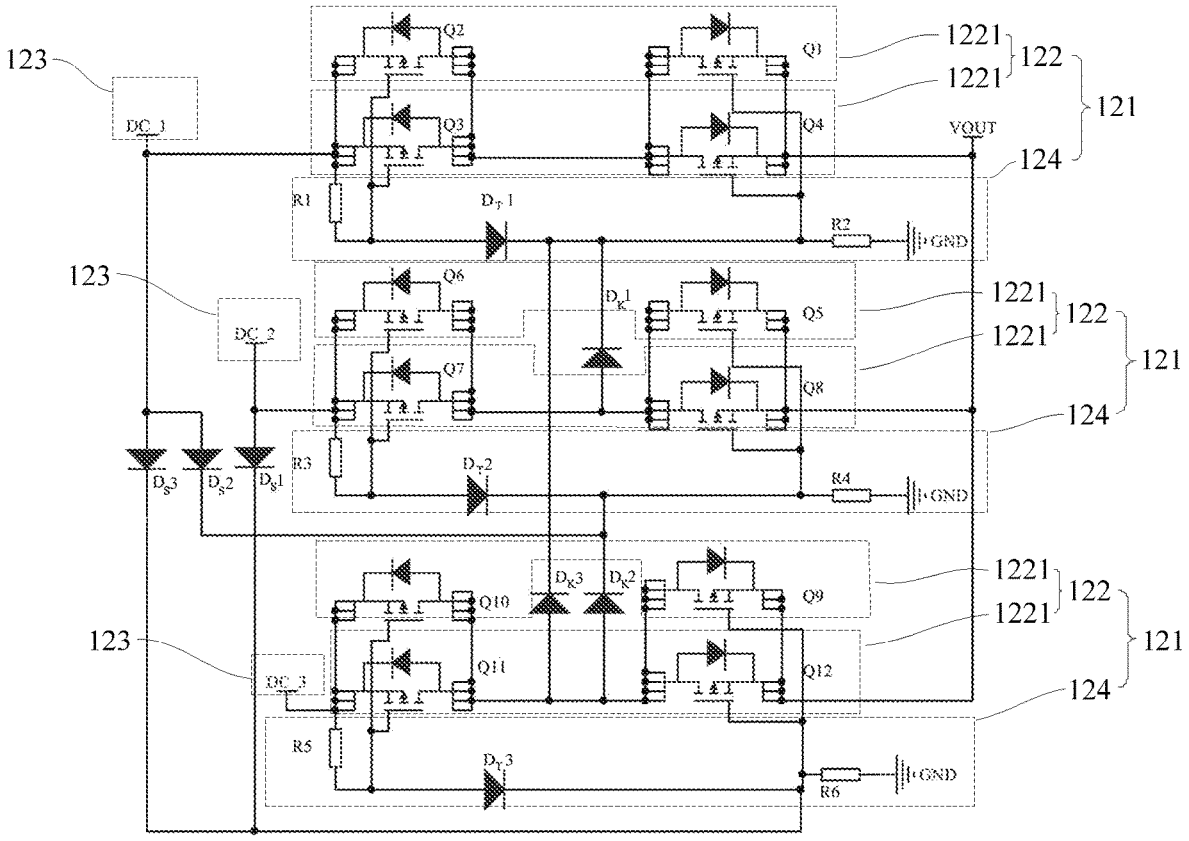
FIG. 4 is a specific circuit structural schematic diagram of a power switching circuit provided by an embodiment of the present disclosure.

In this embodiment, as is shown in FIG. 4, the power input circuit 120 of the lighting device 100 includes 3 power input circuits 121, such as a first power input circuit 121, a second power input circuit 121 and a third power input circuit 121. The power input terminal 123 of the first power input circuit 121 is electrically connected with an AC/DC adapter 160, and configured to electrically connect with a utility power. The utility power is converted to DC1 input through the AC/DC adapter 160. The power input terminal 123 of the second power input circuit 121 is configured to electrically connected with a large capacity battery board (DC2). The power input terminal 123 of the third power input circuit 121 is configured to electrically connected with a small capacity battery board (DC3). The small capacity battery board may be a control box 150 hanged on the lighting device 100, or a battery installed on two sides of the lighting device 100.

When the power input terminal 123 of the first power input circuit 121 is electrically connected with the utility power, the voltage divider circuit 124 of the first power input circuit 121 divides voltage of the utility power, so that in the first power input circuit 121, the gate voltage of the two PMOSFET switch tubes (Q2, Q3) directly electrically connected with the power input terminal 123 is smaller than the source voltage of the two PMOSFET switch tubes (Q2, Q3) directly electrically connected with the power input terminal 123, thus rendering the two PMOSFET switch tubes (Q2, Q3) in a conducting state.

Then, the electric current of the first power input circuit 121 flows through the parasitic diode of the other two of the PMOSFET switch tubes (Q1, Q4), and flows out of the source of the PMOSFET switch tubes (Q1, Q4), so that the source voltage of the other two of the PMOSFET switch tubes (Q1, Q4) is greater than the gate voltage of the other two of the PMOSFET switch tubes (Q1, Q4), thus rendering the other two of the PMOSFET switch tubes (Q1, Q4) in a conducting state, thus rendering all of the PMOSFET switch tubes (Q1-Q4) in a conducting state, so that the utility power supplies power to the light source 110 through the first power input circuit 121.

Moreover, the utility power supplies power to the gates of the PMOSFET switch tubes (Q5-Q12) of the second power input circuit 121 and the third power input circuit 121, to keep the gates of the PMOSFET switch tubes (Q5-Q12) of the second power input circuit 121 and the third power input circuit 121 at high voltage. Thereby, even if the large capacity battery board supplies power to the power input terminal 123 of the second power input circuit 121, or the small capacity battery supplies power to the power input terminal 123 of the third power input circuit 121, the voltage difference between the source voltage and the gate voltage of the PMOSFET switch tubes (Q5-Q12) of the second power input circuit 121 and the third power input circuit 121 cannot reach the preset threshold, so that the PMOSFET switch tubes (Q5-Q12) of the second power input circuit 121 and the third power input circuit 121 remain in an off state.

Thereby, the large capacity battery board cannot supply power to the light source 110 through the second power input circuit 121, and the small capacity battery board cannot supply power to the light source 110 through the third power input circuit 121, thus ensuring that the priority of the first power input circuit 121 is higher than the priority of the second power input circuit 121 and the priority of the third power input circuit 121.

When the power input terminal 123 of the first power input circuit 121 is not electrically connected with the utility power, and the power input terminal 123 of the second power input circuit 121 is electrically connected with the large capacity battery board, the voltage divider circuit 124 of the second power input circuit 121 divides voltage of the large capacity battery board, to render the two PMOSFET switch tubes (Q5-Q8) of the second power input circuit 121 in a conducting state, so that the large capacity battery board supplies power to the light source 110 through the second power input circuit 121.

Moreover, the large capacity battery board supplies power to the gates of the PMOSFET switch tubes (Q9-Q12) of the third power input circuit 121, to keep the gates of the PMOSFET switch tubes (Q9-Q12) of the third power input circuit 121 at high voltage. Thereby even if the small capacity battery supplies power to the power input terminal 123 of the third power input circuit 121, the voltage difference between the source voltage and gate voltage of the PMOSFET switch tubes (Q9-Q12) of the third power input circuit 121 cannot reach the preset threshold, so that the PMOSFET switch tubes (Q9-Q12) of the third power input circuit 121 remain in off states.

Furthermore, the drains of the PMOSFET switch tubes (Q5-Q8) of the second power input circuit 121 supply voltage to the gates of the PMOSFET switch tubes (Q1-Q4) of the first power input circuit 121, to keep the gates of the PMOSFET switch tubes (Q1-Q4) at high voltage, so as to keep the PMOSFET switch tubes (Q1-Q4) disconnected, to prevent the electric current supplied by the large capacity battery board through the second power input circuit 121 from flowing reversely to the first power input circuit 121.

Moreover, even if in a condition that the utility power electrically connected with the power input terminal 123 of the first power input circuit 121 is converted to DC1, and the voltage of the DC1 is low, since the PMOSFET switch tubes (Q1-Q4) of the first power input circuit 121 keep disconnected, thus the utility power electrically connected with the first power input circuit 121 cannot be turned on. In other words, when the high priority power input circuit 121 is electrically connected with the power supply again, as the voltage input by the high priority power input terminal 123 is lower than the voltage input by the low priority power input terminal 123, and the voltage difference between the high priority power input terminal 123 and the low priority power input terminal 123 is smaller than the preset threshold, high priority power input circuit 121 keeps disconnected and cannot supply power to the light source 110 as before.

When the power input terminal 123 of the first power input circuit 121 is not electrically connected with the utility power, the power input terminal 123 of the second power input circuit 121 is not electrically connected with the large capacity battery board, and the power input terminal 123 of the third power input circuit 121 is electrically connected with the small capacity battery, the voltage divider circuit 124 of the third power input circuit 121 divides voltage of the small capacity battery, to render the PMOSFET switch tubes (Q9-Q12) of the third power input circuit 121 in a conducting state, so that the small capacity battery supplies power to the light source 110 through the third power input circuit 121.

Moreover, the drains of the PMOSFET switch tubes (Q9-Q12) of the third power input circuit 121 supply voltage to the gates of the PMOSFET switch tubes (Q1-Q8) of the first power input circuit 121 and the second power input circuit 121, to keep the gates of the PMOSFET switch tubes (Q1-Q8) of the first power input circuit 121 and the second power input circuit 121 at high voltage, so as to keep the PMOSFET switch tubes (Q1-Q8) of the first power input circuit 121 and the second power input circuit 121 disconnected, to prevent the electric current supplied by the small capacity battery through the third power input circuit 121 from flowing reversely to the first power input circuit 121 and the second power input circuit 121.

Moreover, even if in a condition that the utility power connected with power input terminal 123 of the first power input circuit 121 is converted to DC1, the voltage of the DC1 is low, or the voltage of the DC2 electrically connected with the power input terminal 123 of the second power input circuit 121 is low, the PMOSFET switch tubes (Q1-Q8) of the first power input circuit 121 and the second power input circuit 121 cannot be turned on. In other words, when the high priority power input circuit 121 is electrically connected with the power supply again, as the voltage input by the high priority power input terminal 123 is lower than the voltage input by the low priority power input terminal 123, and the voltage difference between the high priority power input terminal 123 and the low priority power input terminal 123 is smaller than the preset threshold, so the high priority power input circuit 121 keeps disconnected and cannot supply power to the light source 110 as before.

Figure 5:
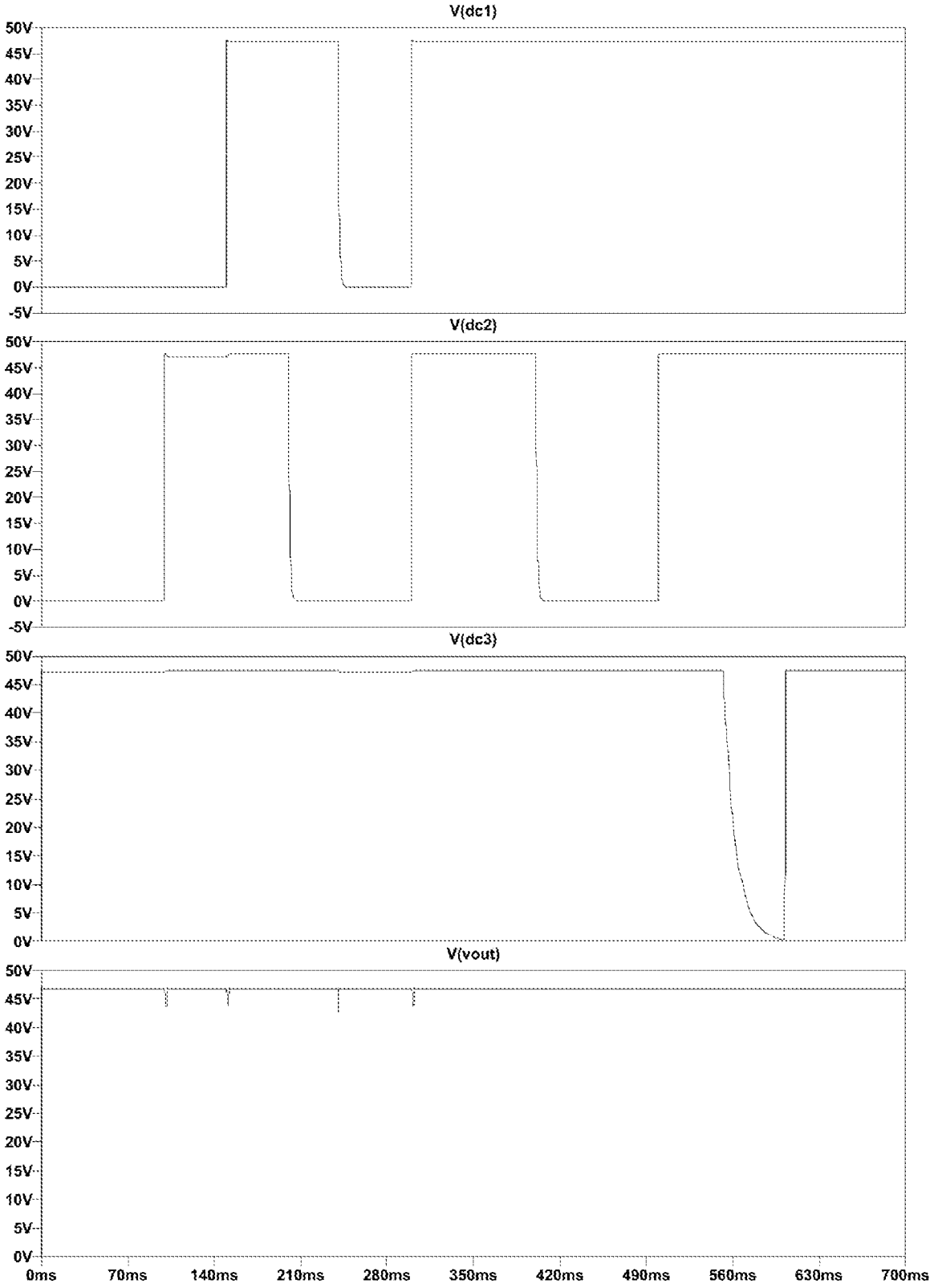
FIG. 5 is a simulation waveform diagram of switching of different power input circuits of the power switching circuit of FIG. 4 provided by an embodiment of the present disclosure.

FIG. 5 illustrates a simulation waveform diagram of switching of the different power input circuits of the power switching circuit provided by an embodiment of the present disclosure. As is shown in the FIG. 5, the time is t, take channels DC1, DC2 and DC3 for example.

In a condition that $0 \leq t \leq 100$ ms, there is no electricity at terminals of the DC1 and DC2, there is electricity at terminal of the DC3, and the voltage of the terminal of the DC3 is 48V. R5, D3 and R6 divide voltage and are in a conducting state, so that the PMOSFET switch tubes Q9 to Q12 meet the turned-on voltage, and the PMOSFET switch tubes Q9 to Q12 are turned on and supply power to the VOUT node electrically connected with the power supply. At the same time, the DC3 controls the gate voltage and the source voltage of the PMOSFET switch tubes Q1 to Q4 to be similar through $D_K3$, and controls the gate voltage and the source voltage of the PMOSFET switch tubes Q5 to Q8 to be similar through $D_K2$. Thus, the voltage cannot satisfy a turned-on voltage. Thereby the channels DC1 and DC2 are turned off, to prevent the electric current from flowing reversely in the channels.

In a condition that $100 < t \leq 150$ ms, there is electricity at the terminals of the DC2 and DC3, and the voltage of the terminals is 48V. As the priority of the DC2 is greater than the priority of the DC3, the DC2 controls the gate voltage and the source voltage of the PMOSFET switch tubes Q1 to Q4 to be similar through $D_K1$, and controls the gate voltage and the source voltage of the PMOSFET switch tubes Q9 to Q12 to be similar through $D_S1$. Thus, the voltage cannot satisfy a turned on voltage. Thereby the channels DC1 and DC3 are turned off. Moreover, R3, $D_T2$ and R4 divide voltage and are in a conducting state, so that the terminal DC2 controls the PMOSFET switch tubes Q5 to Q8 to meet the turned on voltage, and the PMOSFET switch tubes Q5 to Q8 are turned on and supply power to the VOUT node.

In a condition that $150 < t \leq 200$ ms, there is electricity at the terminals of DC1, DC2 and DC3, and the voltage of the terminals of the DC3 is 48V. The DC1 controls the gate voltage and the source voltage of the PMOSFET switch tubes Q5 to Q8 to be similar through $D_S3$, and controls the gate voltage and the source voltage of the PMOSFET switch tubes Q9 to Q12 to be similar through $D_S2$. Thus the voltage cannot satisfy the turn on voltage, thereby the channels DC1 and DC2 are turned off. Moreover, the R1, $D_T1$ and R2 divide voltage and are in conducting states, so that the terminal of DC1 controls the PMOSFET switch tubes Q1 to Q4 to meet the turned on voltage, and the PMOSFET switch tubes Q1 to Q4 are turned on and supply power to the VOUT node.

In a condition that 200<t≤250 ms, the terminal of DC2 is powered-off, there is electricity at the terminals of DC1 and DC3, and the voltages of the terminals of the DC1 and DC3 are 48V. As the priority of the DC1 is greater than the priority of the DC2, the DC1 keeps a state of point 3 (state in the condition of 150<t≤200ms), the PMOSFET switch tubes Q1 to Q4 are turned on and supply power to the VOUT node. As the priority of the DC2 is low, the powered-off of the DC2 has no influence to the power supply of the VOUT node.

In a condition that 250<t≤300 ms, the terminal of DC2 and DC2 are powered-off, there is electricity at the terminal of DC3, and the voltage of the terminal of the DC3 is 48V, back to the state of point 1 (state in the condition of 0≤t≤100 ms).

In a condition that 300<t≤400 ms, there is electricity at the terminals of DC1, DC2 and DC3, and the voltage of the terminals is 48V, back to the state of point 3 (state in the condition of 150<t≤200 ms).

In a condition that 400<t≤500 ms, the terminal of DC2 is powered-off, there is electricity at the terminals of DC1 and DC3, and the voltages of the terminals is 48V, back to the state of point 4 (state in the condition of 200<t≤250 ms).

In a condition that 500<t≤552 ms, there is electricity at the terminals of DC1, DC2 and DC3, and the voltages of the terminals is 48V, back to the state of point 3 (state in the condition of 150<t≤200 ms).

In a condition that 552<t≤600 ms, the terminal of DC3 is powered-off, there is electricity at the terminal of DC1, and the voltage of the terminal of the DC1 is 48V. As the priority of the DC1 is greater than the priority of the DC3, the DC1 keeps the state of point 8 (state in the condition of 500<t≤552 ms), the PMOSFET switch tubes Q1 to Q4 are turned on and supply power to the VOUT node. As the priority of the DC3 is low, the powered-off of the DC3 cannot affect the power supply of the VOUT node.

In a condition that 600<t≤700 ms, there is electricity at the terminals of DC1, DC2 and DC3, and the voltages of the terminals are 48V, back to the state of point 3 (state in the condition of 150<t≤200 ms).

It can been seen from the simulation waveform diagram of switching of the different power input circuits 121 of the power switching circuit 120 of FIG. 5, the controlling of the power switching circuit 120 of the lighting device 100 provided by the embodiment of the present disclosure is realized through pure circuit structures. The reliability of the power switching circuit 120 is high, the response speed of the power switching circuit 120 is faster, the dropping of the input voltage of the power switching circuit 120 is less, thus rendering the lighting device 100 work in flicker-free.

An embodiment of the present disclosure further provides a power switching circuit 120. The power switching circuit 120 includes a plurality of power input circuits 121. Each of the power input circuits 120 includes a power input terminal 123 and a switch control circuit 122. An input terminal of the switch control circuit 122 is electrically connected with the power input terminal 123, output terminals of the switch control circuits 122 of the plurality of power input circuits 121 electrically conduct with each other. A control terminal of an Nth switch control circuit 122 is electrically connected with first to Nth power input terminals 123, an output terminal of the Nth switch control circuit 122 is electrically connected with control terminals of first to (N−1)th switch control circuits 122.

Moreover, the control terminal of the Nth switch control circuit 122 is configured to receive a first electrical signal input by one of first to (N−1)th power input terminals 123, and controls the Nth switch control circuit 122 to be turned off according to the first electrical signal. Moreover, in a condition that a second electrical signal input by the Nth power input terminal 123 is received and the first electrical signal input by one of the first to (N−1)th power input terminals 123 is not received, the control terminal of the Nth switch control circuit 122 is configured to control the Nth switch control circuit 122 to be turned on according to the second electrical signal, and control the first to (N−1)th switch control circuits 122 to be turned off. The N is a positive integer greater than 1.

Moreover, the specific structure of the switch control circuit 122 can be referred to the above embodiments, which are not repeated here.

It should be noted that, the power switching circuit 120 provided by the embodiment of the present disclosure is not only used in the lighting device 100, but also used in other device powered by a plurality of power supplies, such as mobile phone, laptop, recording device or charging box.

An embodiment of the present disclosure further provided a power switching method of the lighting device 100. The lighting device 100 includes a light source 110 and a plurality of power input circuits 121. Each of the power input circuits 121 includes a power input terminal 123 and a switch control circuit 122 connected in series between the power input terminal 123 and the light source 110. A control terminal of an Nth switch control circuit 122 is electrically connected with first to Nth power input terminals 123, an output terminal of the Nth switch control circuit 122 is electrically connected with a control terminal of first to (N−1)th switch control circuits 122.

Figure 6:
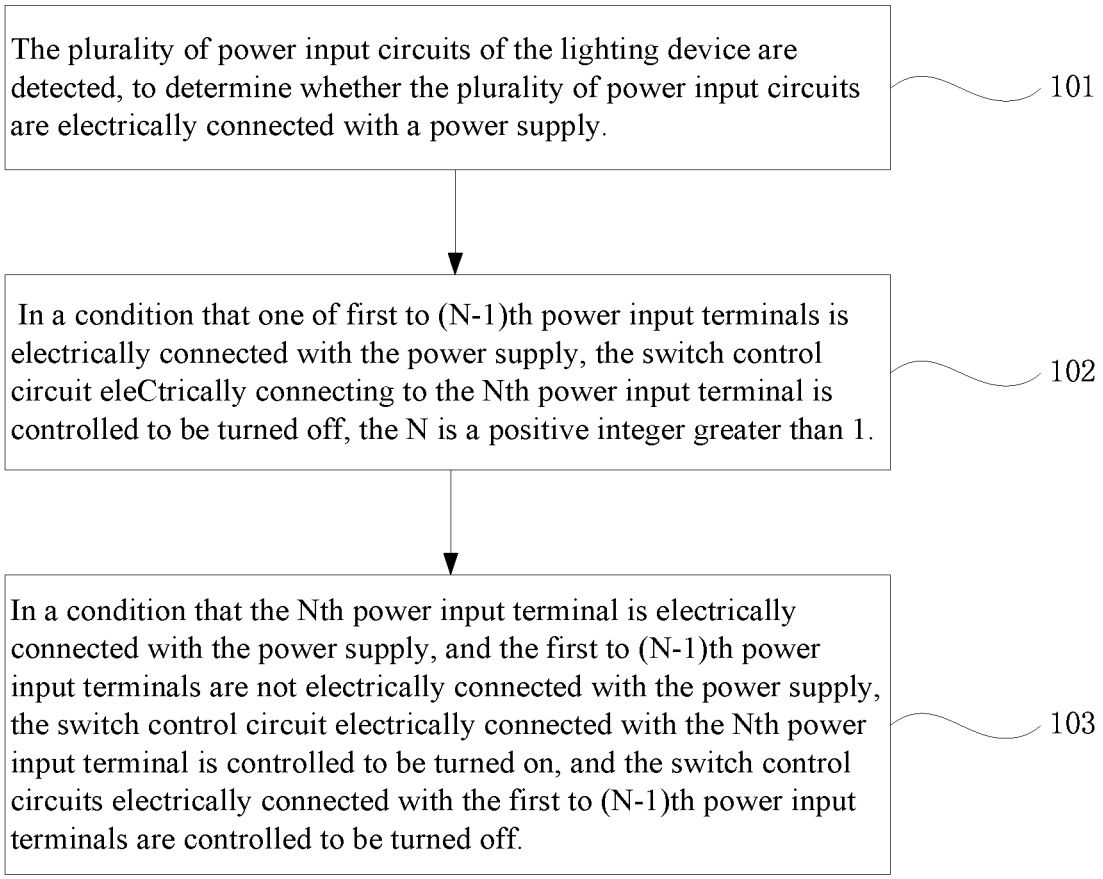
FIG. 6 is an exemplary flowchart of a power switching method of the lighting device provided by an embodiment of the present disclosure.

As is shown in the FIG. 6, the power switching method of the lighting device 100 includes flowing steps:

At block 101, the plurality of power input circuits 123 of the lighting device 100 are detected, to determine whether the plurality of power input circuits 123 are electrically connected with a power supply.

At block 102, in a condition that one of first to (N−1)th power input terminals 123 is electrically connected with the power supply, the switch control circuit 122 electrically connected to the Nth power input terminal 123 is controlled to be turned off, wherein the N is a positive integer greater than 1.

In the power switching method of the lighting device 100 of the embodiment of the present disclosure, the switch control circuit 122 electrically connected to the Nth power input terminal 123 is controlled to be turned off, in a condition that one of first to (N−1)th power input terminals 123 is electrically connected with the power supply. Thereby, it is ensured that when the power input terminal 123 of the high priority power input circuit 121 of the lighting device 100 is electrically with the power supply, thus rendering the low priority power input circuit 121 remain in an off state.

Optionally, in a condition that one of first to (N−1)th power input terminals 123 is electrically connected with the power supply, the switch control circuit 122 electrically connected to the Nth power input terminal 123 is controlled to be turned off, includes flowing steps:

1021, In a condition that any one of first to (N−1)th power input terminals 123 is electrically connected with power supply, a first voltage of the power supply electrically connected with any one of the first to (N−1)th power input terminals 123 is compared with a second voltage of the power supply electrically connected with the Nth power input terminal 123.

1022, if the first voltage is smaller than the second voltage, and the voltage difference between the first voltage and the second voltage is smaller than the preset threshold, the switch control circuit 122 electrically connected with the Nth power input terminal 123 is controlled to be turned on.

1023, if the first voltage is bigger than the second voltage, or the first voltage is smaller than the second voltage, but the voltage difference between the first voltage and the second voltage is equal to or larger than the preset threshold, the switch control circuit 122 electrically connected with the Nth power input terminal 123 is controlled to be turned off.

Thereby, in a condition that the power input terminal 123 of the high priority power input circuit 121 is electrically connected with a power supply, the low priority power input circuit 121 is turned off.

Thereby, in a condition that the voltage input by the high priority power input terminal 123 is low, even if the high priority power input terminal 123 is electrically connected with a power supply, the switch control circuit 122 electrically connected with the high power input terminal 123 is in an off state, and do not supply power for the light source 110, but the power supply electrically connected with the low priority power input terminal 123 supplies power for the light source 110, thus ensuring the working stability of the lighting device 100.

At block 103, in a condition that the Nth power input terminal 123 is electrically connected with the power supply, and the first to (N−1)th power input terminals 123 are not electrically connected with the power supply, the switch control circuit 122 electrically connected with the Nth power input terminal 123 is controlled to be turned on, and the switch control circuits 122 electrically connected with the first to (N−1)th power input terminals 123 are controlled to be turned off.

In the power switching method of the lighting device 100 provided by the embodiment of the present disclosure, in a condition that the Nth power input circuit 121 is electrically connected with a power supply, and the first to (N−1)th power input circuits 121 are not electrically connected with power supplies, the switch control circuit 122 of the Nth power input circuit 121 is in a conducting state, and the light source 110 is powered by the Nth power input circuit 121. In a condition that the first to (N−1)th power input circuits 121 are electrically connected with power supplies, the switch control circuit 122 of the Nth power input circuit 121 is in an off state, and the light source 110 is powered by the first to (N−1)th power input circuits 121.

Thereby, the plurality of power input circuits 121 have a priority relationship between each other, and the priority relationship is: the first power input circuit 121>the second power input circuit 121>the third power input circuit 121> . . . >the Nth power input circuit 121.

Moreover, in a condition that the Nth power input circuit 121 is electrically connected with a power supply, and the first to (N−1)th power input circuits 121 are not electrically connected with power supplies, the switch control circuit 122 of the Nth power input circuit 121 is turned on, the switch control circuit 122 of the Nth power input circuit 121 controls the first to (N−1)th power input circuits 121 to be turned off. Thereby, ensuring that the power supply electrically connected with the Nth power input circuit 121 supplies power to the light source 110, and the power supplies electrically connected with first to (N−1)th power input circuits 121 do not supply power to the light source 110, or the voltages of the power supplies electrically connected with the first to (N−1)th power input circuits 121 are low, the switch control circuits 122 of the first to (N−1)th power input circuits 121 are in off sates. Thereby, when the power supply electrically connected with the low priority power input circuit 121 is supplying power to the light source 110, the electric current is prevented from flowing reversely to the high priority power input circuit 121 from the light source 110, thus improving the working stability of the lighting device 100.

In the embodiments above, the description of each embodiment has its own emphasis, a part not detailed in one embodiment can refer to the related description of other embodiments.

The lighting device, the power switching circuit and the power switching method of the lighting device provided by the embodiments of the present disclosure is introduced in detail. In this paper, specific embodiments are applied to explain the principle and implementation mode of the present disclosure, the above description of the embodiments is only used to help understand the technical solution and its core idea of the application present disclosure. It should be understood by ordinary technicians that: he can still modify the technical solutions described in the preceding embodiments, or equivalent replace some of the technical features, these modifications and replacements do not make the essence of the corresponding technical solution out of the scope of the technical solutions of the embodiments of the present disclosure.

What is claimed is:

1. A lighting device, comprising a light source and a power switching circuit, wherein the power switching circuit comprises:

a plurality of power input circuits, wherein each of the power input circuits comprises:

a power input terminal; and a switch control circuit connected in series between the power input terminal and the light source;

wherein the power switching circuit is electrically connected with a plurality of power supplies, and each power input terminal is electrically connected with one of the plurality of power supplies;

wherein a control terminal of an Nth switch control circuit is electrically connected with first to Nth power input terminals, an output terminal of the Nth switch control circuit is electrically connected with control terminals of first to (N−1)th switch control circuits;

wherein the control terminal of the Nth switch control circuit is configured to receive a first electrical signal input by one of first to (N−1)th power input terminals, and control the Nth switch control circuit to be turned off according to the first electrical signal;

wherein in a condition that a second electrical signal input by the Nth power input terminal is received and the first electrical signal input by one of the first to (N−1)th power input terminals is not received, the control terminal of the Nth switch control circuit is configured to control the Nth switch control circuit to be turned on according to the second electrical signal, and control the first to (N−1)th switch control circuits to be turned off;

wherein in a condition that the Nth power input terminal is electrically connected with a power supply, while the first to (N−1)th power input terminals are not electrically connected with power supplies, the control terminal of the Nth switch control circuit is configured to control the Nth switch control circuit to be turned on, and the light source is powered by the power supply electrically connected with the Nth power input terminal;

wherein in a condition that the first to (N−1)th power input terminals are electrically connected with power supplies, the control terminal of the Nth switch control circuit is configured to control the Nth switch control circuit to be turned off, and the light source is powered by the power supplies electrically connected with the first to (N−1)th power input terminals;

wherein the N is a positive integer greater than 1.

2. The lighting device as claimed in claim 1, wherein the switch control circuit comprises a voltage divider circuit and at least one switch assembly, the switch assembly comprises two PMOSFET switch tubes (Q4n−1, Q4n) in a conducting state, a source of one of the two PMOSFET switch tubes (Q4n−1) is electrically connected with the power input terminal, a source of another of the two PMOSFET switch tubes (Q4n) is electrically connected with the light source, an input terminal of the voltage divider circuit is electrically connected with the power input terminal, and an output terminal of the voltage divider circuit is electrically connected with gates of the two PMOSFET switch tubes (Q4n−1, Q4n).

3. The lighting device as claimed in claim 2, wherein the gates of the PMOSFET switch tubes (Q4n−3 to Q4n) of the Nth switch control circuit are electrically connected with the power input terminals corresponding to the first to (N−1)th switch control circuits.

4. The lighting device as claimed in claim 3, wherein first diodes (DS((n−1)(n−2)+2)/2 to DSn(n−1)/2) are connected in series between the gates of the PMOSFET switch tubes (Q4n−3 to Q4n) of the Nth switch control circuit and the power input terminals corresponding to the first to (N−1)th switch control circuits, a positive electrode of each of the first diodes (DS((n−1)(n−2)+2)/2 to DSn(n−1)/2 is electrically connected with corresponding one of the power input terminals, a negative electrode of each of the first diodes (DS((n−1)(n−2)+2)/2 to DSn(n−1)/2 is electrically connected with corresponding one of the gates of the PMOSFET switch tubes (Q4n−3 to Q4n).

5. The lighting device as claimed in claim 2, wherein drains of the PMOSFET switch tubes (Q4n−3 to Q4n) of the Nth switch control circuit are electrically connected with the gates of the PMOSFET switch tubes (Q1 to Q4n−4) of the first to (N−1)th switch control circuits.

6. The lighting device as claimed in claim 5, wherein the second diodes (DK((n−1)(n−2)+2)/2 to DKn(n−1)/2) are connected in series between the drains of the PMOSFET switch tubes (Q4n−3 to Q4n) of the Nth switch control circuit and the gates of the PMOSFET switch tubes (Q1 to Q4n−4) for the first to (N−1)th switch control circuits, a positive electrode of each of the second diodes (DK((n−1)(n−2)+2)/2 to DKn(n−1)/2) is electrically connected with corresponding one of the output terminals of the switch control circuits, a negative electrode of each of the second diodes (DK((n−1)(n−2)+2)/2 to DKn(n−1)/2) is electrically connected with corresponding one of the gates of the PMOSFET switch tubes (Q1 to Q4n−4) for the first to (N−1) switch control circuits.

7. The lighting device as claimed in claim 2, wherein each of the voltage divider circuits comprises a first electric resistance (R2n−1) and a second electric resistance (R2n), an input terminal of the first electric resistance (R2n−1) is electrically connected with the power input terminal, an output terminal of the first electric resistance (R2n−1) is electrically connected with an input terminal of the second electric resistance (R2n) and the gates of the two PMOSFET switch tubes (Q4n−1, Q4n), an output terminal of the second electric resistance (R2n) is connected with earth.

8. The lighting device as claimed in claim 7, wherein each of the power input circuits further comprise a third diode (DTn), a positive electrode of the third diode (DTn) is electrically connected with the output terminal of the first electric resistance (R2n−1), a negative electrode of the third diode (DTn) is electrically connected with the gates of the two PMOSFET switch tubes (Q4n−3, Q4n).

9. The lighting device as claimed in claim 2, wherein each of the switch control circuits comprises a plurality of switch assemblies, the plurality of switch assemblies are connected in parallel with each other, drains of the PMOSFET switch tubes (Q4n−3 to Q4n) of the plurality of switch assemblies are in a conducting state, in each of the switch assemblies, the source of one of the two PMOSFET switch tubes (Q4n−1) is electrically connected with the power input terminal, and the source of another of the PMOSFET switch tubes (Q4n) is electrically connected with the light source.

10. The lighting device as claimed in claim 1, wherein the plurality of power supplies are multiple types of power supplies, and the multiple types of power supplies are a utility power, a large capacity battery board or a small capacity battery board.

11. The lighting device as claimed in claim 1, wherein in a condition that voltages of the power supplies electrically connected with the first to (N−1)th power input terminals are low, the first to (N−1)th switch control circuits are turned on, the Nth switch control circuit is turned on, and the light source is supplied by the power supply connected with the Nth power input terminal.

12. A power switching circuit, comprising:

a plurality of power input circuits, wherein each of the power input circuits comprises:

a power input terminal; and a switch control circuit connected in series between the power input terminal and the light source;

wherein the power switching circuit is electrically connected with a plurality of power supplies, and each power input terminal is electrically connected with one of the plurality of power supplies;

wherein a control terminal of an Nth switch control circuit is electrically connected with first to Nth power input terminals, an output terminal of the Nth switch control circuit is electrically connected with control terminals of first to (N−1)th switch control circuits;

wherein the control terminal of the Nth switch control circuit is configured to receive a first electrical signal input by one of first to (N−1)th power input terminals, and control the Nth switch control circuit to be turned off according to the first electrical signal;

wherein in a condition that a second electrical signal input by the Nth power input terminal is received and the first electrical signal input by one of the first to (N−1)th power input terminals is not received, the control terminal of the Nth switch control circuit is configured to control the Nth switch control circuit to be turned on according to the second electrical signal, and control the first to (N−1)th switch control circuits to be turned off;

wherein in a condition that the Nth power input terminal is electrically connected with a power supply, while the first to (N−1)th power input terminals are not electrically connected with power supplies, the control terminal of the Nth switch control circuit is configured to control the Nth switch control circuit to be turned on, and the light source is powered by the power supply electrically connected with the Nth power input terminal;

wherein in a condition that the first to (N−1)th power input terminals are electrically connected with power supplies, the control terminal of the Nth switch control circuit is configured to control the Nth switch control circuit to be turned off, and the light source is powered by the power supplies electrically connected with the first to (N−1)th power input terminals;

wherein the N is a positive integer greater than 1.

13. The power switching circuit as claimed in claim 12, wherein the switch control circuit comprises a voltage divider circuit and at least one switch assembly, the switch assembly comprises two PMOSFET switch tubes (Q4n−1, Q4n) in a conducting state, a source of one of the two PMOSFET switch tubes (Q4n−1) is electrically connected with the power input terminal, a source of another of the two PMOSFET switch tubes (Q4n) is electrically connected with a light source, an input terminal of the voltage divider circuit is electrically connected with the power input terminal, and an output terminal of the voltage divider circuit is electrically connected with gates of the two PMOSFET switch tubes (Q4n−1, Q4n).

14. The power switching circuit as claimed in claim 13 wherein the gates of the PMOSFET switch tubes (Q4n−3 to Q4n) of the Nth switch control circuit are electrically connected with the power input terminals corresponding to the first to (N−1)th switch control circuits.

15. The power switching circuit as claimed in claim 14, wherein first diodes (DS((n−1)(n−2)+2)/2 to DSn(n−1)/2) are connected in series between the gates of the PMOSFET switch tubes (Q4n−3 to Q4n) of the Nth switch control circuit and the power input terminals corresponding to the first to (N−1)th switch control circuits, a positive electrode of each of the first diodes (DS((n−1)(n−2)+2)/2 to DSn(n−1)/2 is electrically connected with corresponding one of the power input terminals, a negative electrode of each of the first diodes (DS((n−1)(n−2)+2)/2 to DSn(n−1)/2 is electrically connected with corresponding one of the gates of the PMOSFET switch tubes (Q4n−3 to Q4n).

16. The power switching circuit as claimed in claim 13, wherein drains of the PMOSFET switch tubes (Q4n−3 to Q4n) of the Nth switch control circuit are electrically connected with the gates of the PMOSFET switch tubes (Q1 to Q4n−4) of the first to (N−1)th switch control circuits.

17. The power switching circuit as claimed in claim 16, wherein the second diodes (DK((n−1)(n−2)+2)/2 to DKn(n−1)/2) are connected in series between the drains of the PMOSFET switch tubes (Q4n−3 to Q4n) of the Nth switch control circuit and the gates of the PMOSFET switch tubes (Q1 to Q4n−4) for the first to (N−1)th switch control circuits, a positive electrode of each of the second diodes (DK((n−1)(n−2)+2)/2 to DKn(n−1)/2) is electrically connected with corresponding one of the output terminals of the switch control circuits, a negative electrode of each of the second diodes (DK((n−1)(n−2)+2)/2 to DKn(n−1)/2) is electrically connected with corresponding one of the gates of the PMOSFET switch tubes (Q1 to Q4n−4) for the first to (N−1) switch control circuits.

18. The power switching circuit as claimed in claim 13, wherein each of the voltage divider circuits comprises a first electric resistance (R2n−1) and a second electric resistance (R2n), an input terminal of the first electric resistance (R2n−1) is electrically connected with the power input terminal, an output terminal of the first electric resistance (R2n−1) is electrically connected with an input terminal of the second electric resistance (R2n) and the gates of the two PMOSFET switch tubes (Q4n−1, Q4n), an output terminal of the second electric resistance (R2n) is connected with earth.

19. The power switching circuit as claimed in claim 18, wherein each of the power input circuits further comprise a third diode (DTn), a positive electrode of the third diode (DTn) is electrically connected with the output terminal of the first electric resistance (R2n−1), a negative electrode of the third diode (DTn) is electrically connected with the gates of the two PMOSFET switch tubes (Q4n−3, Q4n).

20. The power switching circuit as claimed in claim 13, wherein each of the switch control circuits comprises a plurality of switch assemblies, the plurality of switch assemblies are connected in parallel with each other, drains of the PMOSFET switch tubes (Q4n−3 to Q4n) of the plurality of switch assemblies are in a conducting state, in each of the switch assemblies, the source of one of the two PMOSFET switch tubes (Q4n−1) is electrically connected with the power input terminal, and the source of another of the PMOSFET switch tubes (Q4n) is electrically connected with the light source.

* * * * *